US010907335B2

(12) United States Patent
Jackman

(10) Patent No.: US 10,907,335 B2
(45) Date of Patent: Feb. 2, 2021

(54) TELESCOPING TOILET MOUNTING FLANGE

(71) Applicant: John David Jackman, Framingham, MA (US)

(72) Inventor: John David Jackman, Framingham, MA (US)

( * ) Notice: Subject to any disclaimer, the term of this patent is extended or adjusted under 35 U.S.C. 154(b) by 0 days.

(21) Appl. No.: 14/982,765

(22) Filed: Dec. 29, 2015

(65) Prior Publication Data

US 2017/0183856 A1 Jun. 29, 2017

(51) Int. Cl.
*E03D 11/16* (2006.01)

(52) U.S. Cl.
CPC ..... *E03D 11/16* (2013.01)

(58) Field of Classification Search
CPC ..... E03D 11/16; E03D 11/17
USPC ..... 285/56, 58; 4/252.1–252.6; 411/395
See application file for complete search history.

(56) References Cited

U.S. PATENT DOCUMENTS 827,230 A * 7/1906 Goeppinger ..... F16B 43/00 411/368
827,320 A * 7/1906 O'Leary ..... B60L 9/26 307/16
1,206,580 A * 11/1916 O'Leary ..... E03D 11/16 285/343
2,837,750 A * 6/1958 Robinson ..... E03D 11/16 285/201
3,400,411 A * 9/1968 Harvey ..... E03D 11/14 4/252.6
3,501,172 A * 3/1970 Pickard ..... E03D 11/16 285/374
4,515,398 A * 5/1985 Machon, Sr. ..... E03D 11/16 285/12
5,185,890 A * 2/1993 Dismore ..... E03D 11/16 4/252.1
5,421,036 A * 6/1995 Stevens ..... E03D 11/16 285/60
5,608,922 A 3/1997 Lewis
5,862,533 A 1/1999 Johnson
6,065,160 A 5/2000 Winn
6,254,141 B1 * 7/2001 Piper ..... E03D 11/16 285/56
6,367,093 B1 * 4/2002 Hawro ..... E03D 11/16 4/252.1
6,438,765 B1 10/2002 Johnson
6,519,784 B2 2/2003 Carwile
6,598,241 B1 6/2003 Williams
6,615,413 B1 9/2003 Grant
6,719,294 B2 4/2004 Nguyen
6,745,408 B2 * 6/2004 Spells, Sr. ..... E03D 11/16 4/252.1
7,069,603 B2 7/2006 Flushing
8,281,421 B2 * 10/2012 Hughes ..... E03D 11/16 4/252.5
9,051,723 B2 * 6/2015 Junca ..... E03D 11/16
(Continued)

*Primary Examiner* — David P Angwin
*Assistant Examiner* — Nicholas A Ros
(74) *Attorney, Agent, or Firm* — Thomas P. O'Connell; O'Connell Law Firm

(57) ABSTRACT

A two section telescoping toilet mounting flange for the installation and connection of a toilet to a waste water pipe consisting of an upper male section attached to the toilet base thru toilet base mounting holes and a lower female section with threaded holes for top bolting and mounting of the toilet to a floor and plumbing.

6 Claims, 6 Drawing Sheets

(56) References Cited

U.S. PATENT DOCUMENTS

| | | | | |
|---|---|---|---|---|
| 9,169,629 | B2 | 10/2015 | Jensen | |
| 9,556,603 | B2 | 1/2017 | Guthrie | |
| 2010/0123307 | A1* | 5/2010 | Coronado | E03D 11/16 285/56 |
| 2012/0240319 | A1* | 9/2012 | Yssel | E03D 11/16 4/252.1 |

* cited by examiner

TELESCOPING TOILET MOUNTING FLANGE

CROSS REFERENCE TO RELATED APPLICATIONS

This application is based on a provisional application Ser. No. 62/097,357 filed Dec. 29, 2014 by the same inventor which is hereby incorporated by reference.

BACKGROUND OF THE INVENTION

Field of the Invention

The device of this invention resides in the area of closet flanges for mounting toilets on floors where traditional toilet anchor bolts, also known as johnny bolts, and a wax ring are used to bolt down and seal the toilet to the waste pipe and floor.

Description of the Prior Art

Closet flanges of varied designs are well known in the plumbing industry. In residential use, the vast majority are constructed of PVC and/or in combination with a metal outer ring. Such closet flanges have a top outer ring where holes allow attachment to floor and slots are cut to allow fitting of anchor bolts to be set below mounting holes in toilet base. Inside the outer ring is a lowered donut shaped section where a wax ring forms a seal around the discharge horn at the bottom of the toilet. A lower pipe shaped portion attaches to a waste pipe beneath the floor level. Closet flanges are designed to be installed on top of the finished floor to keep the proximity of the toilet horn and the lowered area of the flange at the intended spacing for a standard wax ring to fill. When a toilet is removed and raised with flooring material such as tile applied under its base, the spacing for the wax ring is increased beyond its capacity and may not seal properly. Wax rings are well known and are the accepted method to create a seal between the toilet and the closet flange. To install a toilet with a wax ring seal a person must first set the toilet on its back or side and press the wax ring firmly on to the area around the horn on the bottom of the toilet.

To further prepare for setting the toilet, a person must set two anchor bolts vertically into the slots in the flange. Some brands of these bolts include a pair of plastic circular retainers to hold the bolts upright. Plumbers often use some of the wax ring to stabilize the bolts. To set the toilet in place one must hold it just above the closet flange in exactly the right place and lower it carefully, allowing both anchor bolts to pass up thru holes provided in the toilet base. If the bolts miss the elongated holes in the toilet base, they will bend laterally and the toilet must be removed and set on its side or back to prepare for another try. Once pressed into place nuts are tightened onto the bolts to prevent movement of the toilet. Since toilet bases vary in thickness, most anchor bolts are made longer than necessary and excess must be cut away with a hacksaw to allow proper fitting of a plastic cap.

Further, wax rings are known to leak as they can miss the intended location, can fall off unnoticed and can be forced out of the flange laterally on one side or not be thick enough to fill in the intended area. Heated floors can also cause the wax to liquefy and weep out from under the toilet base.

SUMMARY OF THE INVENTION

The invention may be summarized as a telescoping toilet closet flange providing a two part assembly that utilizes a combination of an upper male section that is attached by screws or bolts, for example, to the underside of the toilet base thru the innermost area of standardized elongated holes in the toilet base into a steel plate set on top of the toilet base, and a lower female section attached to the toilet base support surface or floor into which the upper section is positioned. An annular layer of adhesive sealant is deposed on a flattened area between the upper male section and the bottom of the toilet. This creates a rugged and watertight seal that cannot be dislodged while setting the toilet.

It is a feature of the invention to provide a method to precisely align the upper male section with its adhesive sealant and attach it to the bottom of the toilet in the correct location, centered around the discharge horn. To accomplish this, the attachment screws are positioned in the openings of the flange and firmly held while the ends of the screws are pushed thru the mounting holes in the toilet base.

It is an additional feature of this invention that the upper male section is fitted with either a plurality of O-rings or ribbed type seals disposed around its outer circumference creating a watertight seal with the lower female section.

It is another feature of this invention to provide a washer plate to be set on top of the toilet base with a threaded hole to receive the upper male section attachment screws or bolts, as well as an unthreaded hole disposed adjacent to it to bolt down the toilet to the lower female section of the flange.

Further features of the invention include:

the use of the laterally elongated toilet base holes whose positioning, size, and spacing is standard to all toilet bases to allow two side-by-side screws or bolts to pass thru each elongated hole to accomplish the purpose of this device rather than its present use for a singular pre-placed standard anchor bolt;

providing an embodiment where a single hollow bolt with exterior threads is permanently attached to each side of the upper male flange section allowing attachment to the bottom of the toilet and providing a means for an additional bolt to pass inside the hollow bolt to secure the toilet to the lower female flange section;

providing a simple direct bolt down of the toilet to the lower part of the closet flange without the need for conventional anchor bolts or a wax ring which is accomplished by fitting the lower female section of this invention with both standard predrilled holes to screw the device to subflooring as well as threaded holes aligned to the outermost area of the toilet base elongated holes; and providing a means to allow a toilet to have a variable or telescoping watertight height tolerance allowing installation of the lower female section of the flange to be installed directly to a subfloor during rough plumbing procedures thereby reducing the number of installation processes requiring additional visits by a plumber. The rough plumbing process for this devise can include permanent attachment of the lower female section to the waste pipe and floor. Flooring materials can abut the edge of the lower section of the flange and no longer must be positioned beneath it.

More features of the invention include:

obviating the need of an installer to acquire, purchase or install any additional seals, seal extensions or separate devices to create a watertight and dependable seal due to a toilets increased proximity to a closet flange as a result of varying thicknesses of flooring material installed under the toilet base;

constructing both upper and lower sections entirely of metal, plastic, or combinations of metal and plastic;

the use of the upper male section independently of the lower female section as it can be attached to the toilet and fit directly inside of a fixed pipe and the toilet screwed directly to the floor; and providing an additional lower female flange section specifically designed to be embedded in concrete and to allow an installer to create a rigid bolt down of the toilet without drilling into the concrete slab.

DESCRIPTION OF THE PREFERRED EMBODIMENT

Figure 1:
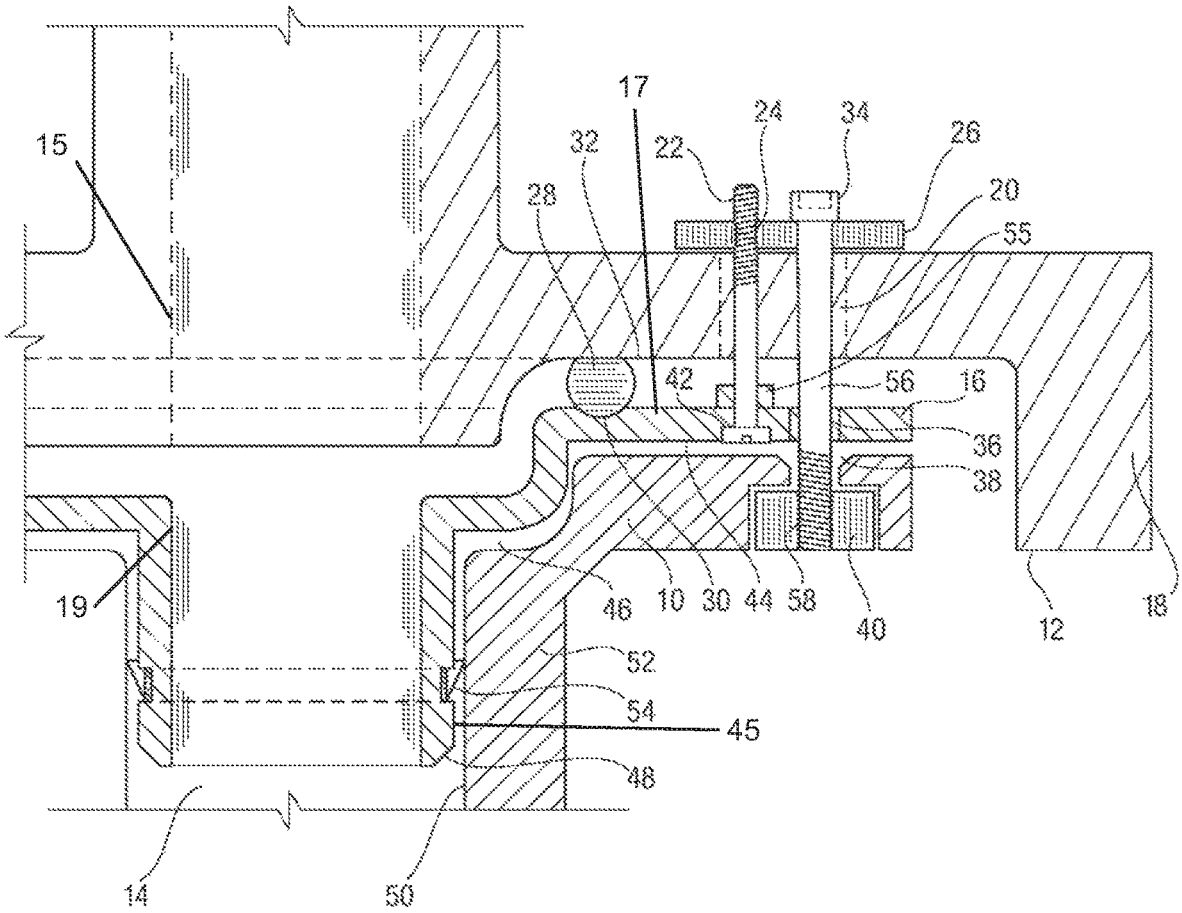
FIG. 1 is a cross-sectional view of the preferred embodiment of the invention.

Referring to FIG. 1, there is shown a cross-sectional frontal view of the structure of the invention. Lower female flange section 10 is attached to the upper edge 12 of the floor and waste pipe 14 below. Upper male flange section 16 is attached to toilet base 18 thru hole 20 with attachment screw 22 threaded into female threads 24 of steel mounting plate 26 disposed atop base 18. As left and right screws 22 on either side of the base 18 are tightened, sealant material 28 prepositioned in lowered contact area 30 and contacting underside 32 of toilet base 18 creates a watertight seal between upper flange 16 and the underside of the toilet base.

Toilet base 18 is attached to lower female flange 10 with bolt 34 thru steel plate 26 continuing thru hole 36 in the upper flange 16 into tapered opening 38 and threaded into steel floor mounting plate 40. Recessed area 42 allows screw 22 to be flush with planar surface 44 of upper flange 16 allowing clearance 46 to be minimized. As the toilet, with upper flange 16 attached, is lowered into place, tapered end 48 of upper flange 16 is easily aligned with inner side-wall 50 of tubular wall section 52 of the lower portion of lower section 10. Circular ribbed sanitary seal 54 creates a water and gas proof seal.

In order to prevent over compression of sealant material 28, an integral proximity stop 55 is provided, for example, surrounding the shank 56 of attachment screw 22, to prevent over compression of sealant material 28 or stressing and possibly cracking the entire flange.

Embodiments of the invention can thus be characterized as a telescoping toilet mounting flange for the installation and connection of a toilet base 18 to a floor and waste water pipe 14. The toilet base 18 has two spaced apart mounting holes 20, one on each side of the base, and a wastewater discharge port 15. The telescoping toilet mounting flange comprises an upper male section 16 attachable to the toilet base 18 thru the toilet base mounting holes 20. As seen, for instance, in FIG. 1, the upper male section 16 comprises a ring 17 having an interior port 19 concentric with the toilet base wastewater discharge port 15. The ring 17 of the upper male section 16 further has two spaced apart mounting holes 36 arranged to be aligned with the toilet base mounting holes 20. The ring 17 further has a flanged portion 45 with a tapered end 48 arranged to extend downward into the waste water pipe 14. An upper male section attachment ring connection means is formed by bolts 22 upwardly disposable through upper male section ring mounting holes and the toilet base mounting holes 20 as aligned. A threaded plate 26 is disposable atop each of the toilet base mounting holes 20 for receiving the bolt 22. An adhesive sealant ring 28 is disposable between the toilet base 18 and upper male section 16. The sealant ring 28 is arranged to be concentric with the interior port 19 of the upper male section 16. The sealant ring 28 is arranged to be compressed upon tightening the bolts 22 and the threaded plates 26. A lower female section 10 is attachable to the floor. The lower female section 10 has threaded holes 58 aligned with the toilet base mounting holes 20 for top bolting and mounting of the toilet to the floor and the waste water pipe 14. The lower female section 10 further has a flanged tubular wall section portion 52 arranged to extend downward into the waste water pipe 14. A sealing ring can be disposed between the upper male section flanged portion and the lower female section flanged portion.

Figure 2:
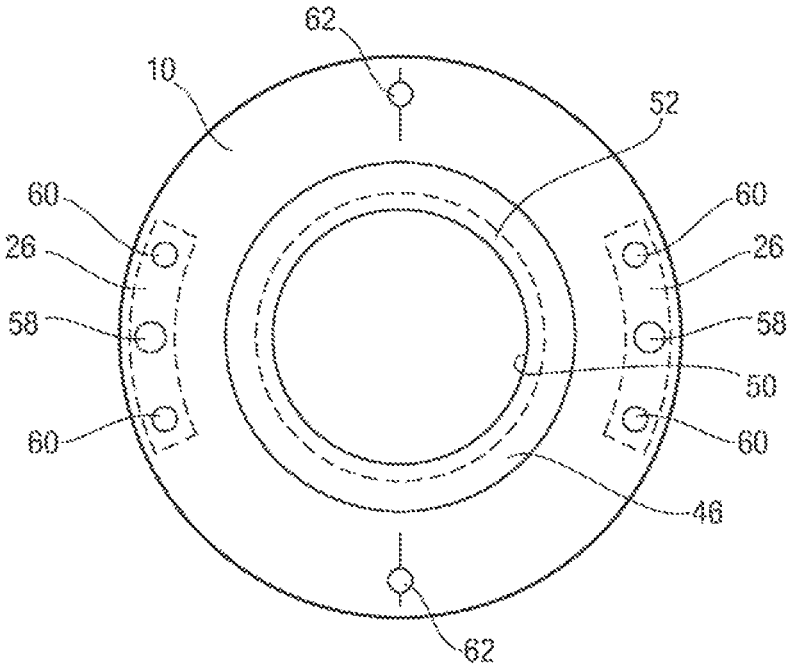
FIG. 2 is a top view of one component of the preferred embodiment of the invention.

FIG. 2 illustrates a top view of lower section 10 depicting steel floor mounting plates 40 embedded in the underside of lower section 10. Threaded bolt down holes 58 are shown centered between lower flange section 10 floor attachment screw down holes 60. Holes 62 provide for optional and additional floor attachment as may be required for additional strength.

Figure 3:
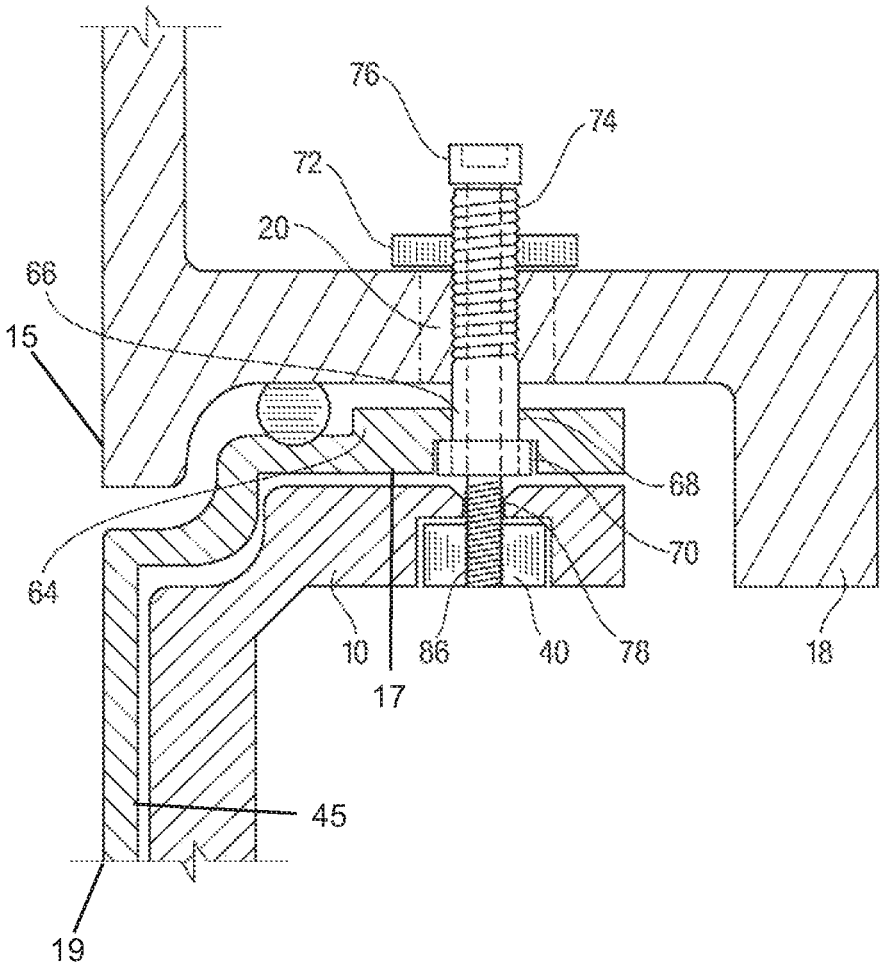
FIG. 3 is a cross-sectional view of an alternative embodiment of a component of the invention.

FIG. 3 is a cross-sectional view of an alternative embodiment of a component of the invention consisting of the toilet bolt down assembly and the configuration of the upper flange toilet attachment components of the invention. Upper male flange section 64 is attached to the underside of toilet base 18 utilizing two hollow bolts 66, one per each side of the toilet base, slid thru hole 68 and captured in hexagonal recess 70 and further slid thru oval holes 20 common to all toilet bases.

Upper flange 64 is secured in place and the waterproof sanitary seal is compressed by tightening down toilet base bolt nut 72 on to exterior threads 74 of bolt 66. Installation is completed by now setting the toilet in place and passing toilet bolt down screw 76 down into hollow bolt 66 thru countersunk locator 78 and into threaded hole 58 in steel floor mounting plate 40 and tightening the bolts on both sides of toilet base 18.

Figure 4:
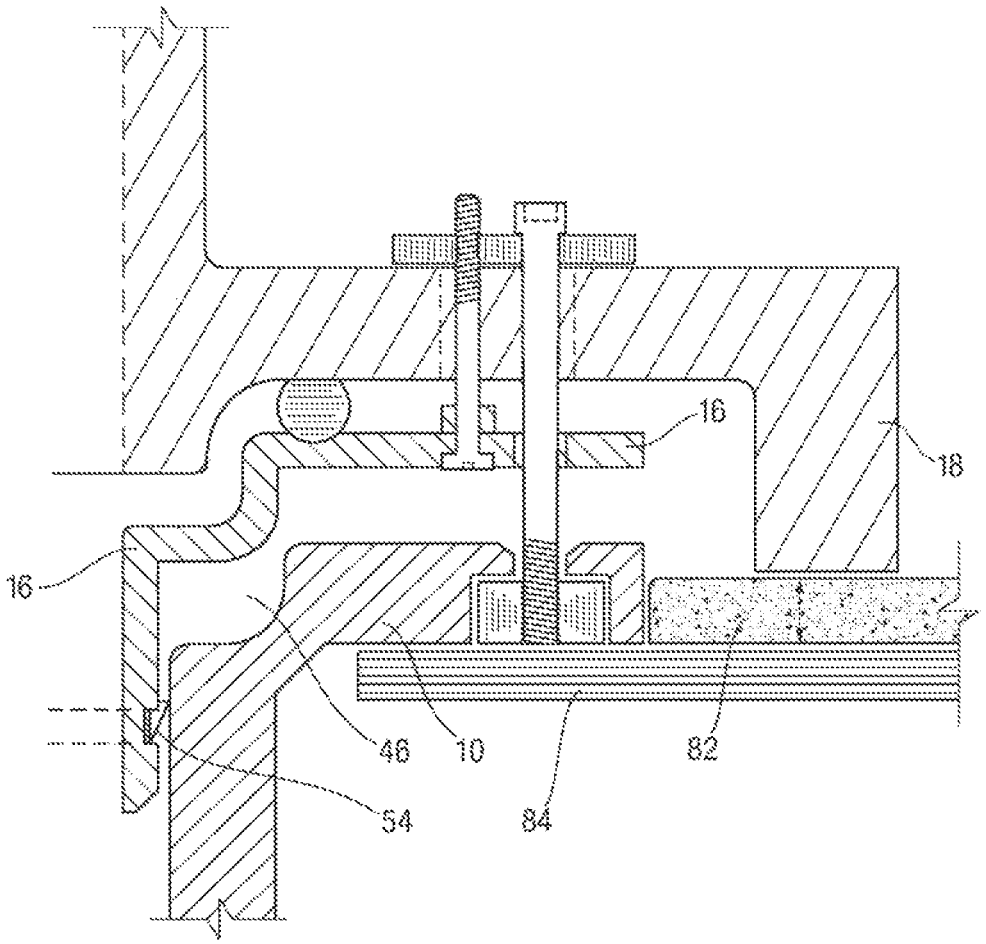
FIG. 4 is a cross-sectional illustration of the employment of the invention.

FIG. 4 is a cross-sectional illustration of the employment of the invention, using the attachment mechanism of FIG. 1, wherein an additional flooring layer is added to the subfloor. This illustrates the telescoping capability of this invention as it relates to additional flooring material 82, tile for example, placed under toilet base 18 after lower female flange section 10 has been attached directly to subfloor 84. Clearance 46 has accordingly been expanded. Circular ribbed sanitary seal 54 remains effective while toilet base 18 is on top of installed floor tile 82.

Figure 5:
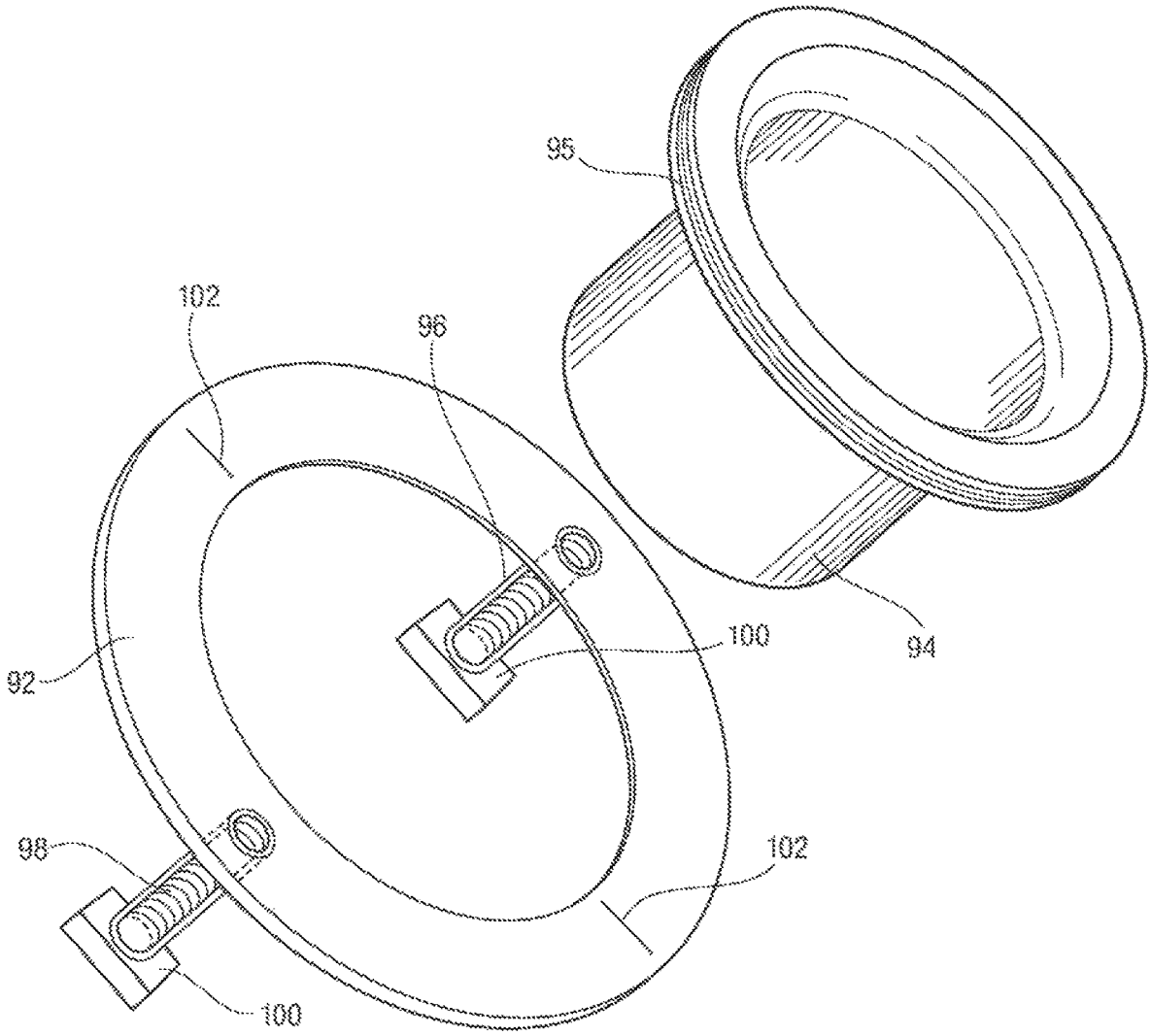
FIG. 5 is a perspective view of an alternative embodiment of the invention.

FIG. 5 illustrates an alternative embodiment of the lower female flange portion of this invention that is designed to be embedded in a poured concrete floor while the concrete is in liquid form. This lower female portion is made from an upper steel washer shaped ring 92 rotatably attached to a lower plastic waste water pipe connection 94 in, for example, groves 95 and two firmly attached tubular sleeves 96 having interior threads 98. A metal foot 100 is firmly attached at the bottom of each threaded sleeve to anchor the device into the concrete floor when the concrete has hardened and to further secure the toilet to the floor 97 and the waste pipe 99. The benefit of this embodiment is that an installer of a toilet will not have to drill into hardened concrete in order to attach a toilet flange and toilet to a floor and waste pipe. This structure provides the same pre-disposed threaded holes for bolting down a toilet to a floor and a waste pipe as shown in FIG. 1 which is designed for a wood floor structure.

Figure 6:
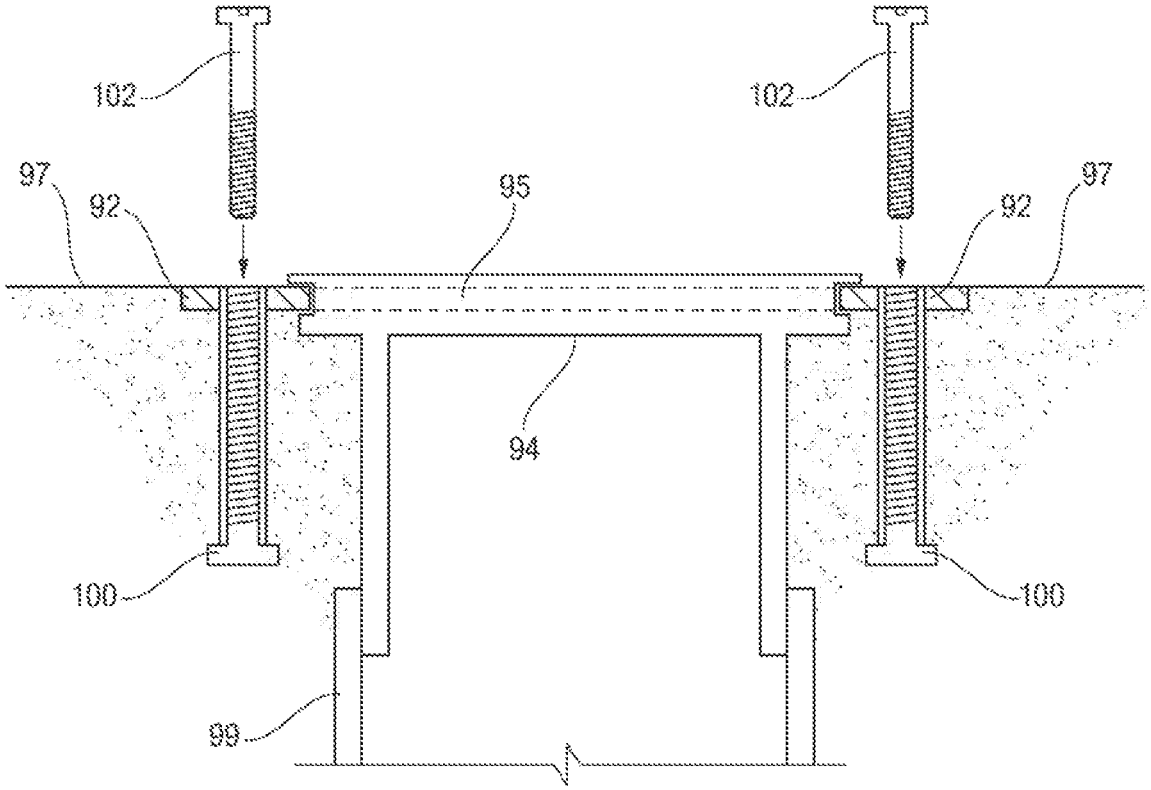
FIG. 6 is a cross-sectional view of the embodiment of FIG. 5.

As further shown in the cross-sectional view of FIG. 6, this embodiment consists of an upper metal circular ring 92 rotatably attached to lower plastic connection 94 with two attached downward extending internally threaded sleeves 96 supported by feet 100 for receiving toilet base installation bolts 102.

The toilet attachment method of this embodiment will allow independent rotation of the upper metal portion from the lower plastic portion. The independent rotation of both the upper metal flange and lower plastic waste water pipe connection will allow an installer to glue the lower pipe connection to the waste water pipe and then rotate the upper metal portion to the proper position, using registration marks 102, in relation to the wall behind the toilet and at ninety degrees from sleeve 96 as concrete hardens considerably slower than traditional plastic cements.

What is claimed is:

1. A telescoping toilet mounting assembly connecting a toilet with a toilet base with first and second spaced mounting holes and a wastewater discharge port to a floor and a wastewater pipe with a female flange section, the toilet mounting assembly comprising:

a male flange section with an interior port mounted concentric with the wastewater discharge port of the toilet base, a ring with first and second spaced mounting holes aligned with the first and second mounting holes of the toilet base, and a portion that extends into the wastewater pipe;

first and second hollow bolts respectively received through the first and second mounting holes of the male flange section and through the first and second mounting holes of the toilet base wherein the first and second hollow bolts have exterior threads;

first and second base bolt nuts tightened on to the exterior threads of the first and second hollow bolts respectively;

first and second mounting members retained by the female flange section of the wastewater pipe wherein the first and second mounting members have threaded holes; and first and second toilet bolt down screws passed through the first and second hollow bolts respectively and into the threaded holes in the first and second mounting members retained by the female flange section of the wastewater pipe;

whereby the male flange section is attached to the toilet base with the first and second hollow bolts passed through the first and second mounting holes of the male flange section and through the first and second mounting holes of the toilet base and the first and second base bolt nuts tightened onto the first and second hollow bolts and whereby the toilet base and the male flange section attached to the toilet base are attached to the wastewater pipe by passing the first and second toilet bolt down screws through the first and second hollow bolts and into the first and second mounting members retained by the female flange section of the wastewater pipe.

2. The toilet mounting assembly of claim 1 wherein the first and second mounting members comprise mounting plates.

3. The toilet mounting assembly of claim 1 further comprising sanitary seal material interposed between the toilet base and the male flange section for creating a watertight seal between the toilet base and the male flange section.

4. The toilet mounting assembly of claim 3 wherein the sanitary seal material comprises an adhesive sealant ring compressed between the toilet base and the male flange section by the first and second base bolt nuts tightened onto the exterior threads of the first and second hollow bolts respectively.

5. The toilet mounting assembly of claim 1 further comprising first and second recesses in the male flange section, wherein the first and second recesses respectively capture the first and second hollow bolts.

6. The toilet mounting assembly of claim 5 wherein the first and second recesses are hexagonal.

* * * * *